US006243478B1

(12) United States Patent
Tsao

(10) Patent No.: US 6,243,478 B1
(45) Date of Patent: Jun. 5, 2001

(54) FLAT SPEAKERS FOR PERSONAL COMPUTER

(76) Inventor: Mark Tsao, 2Fl., No.13, Alley 2, Lane 20, Sec. 1, Min-Der Rd., Tu-Chen City, Taipei Hsien (TW)

( * ) Notice: Subject to any disclaimer, the term of this patent is extended or adjusted under 35 U.S.C. 154(b) by 0 days.

(21) Appl. No.: 09/414,018

(22) Filed: Oct. 6, 1999

(51) Int. Cl.[7] ..... H04R 25/00

(52) U.S. Cl. ..... 381/388; 381/306; 381/333; 381/431; 361/683

(58) Field of Search ..... 381/300, 301, 381/303–307, 333, 334, 345, 386, 387, 388, 423, 425, 431; 361/679, 681, 682, 683; 364/708.1

(56) References Cited

U.S. PATENT DOCUMENTS 1,819,721 * 8/1931 Stone ..... 381/388
4,122,314 * 10/1978 Matsuda et al. ..... 381/431
4,472,604 * 9/1984 Nakamura et al. ..... 381/425
5,732,140 * 3/1998 Thayer ..... 381/300
5,930,376 * 7/1999 Markow et al. ..... 381/333
6,151,401 * 11/2000 Annaratone ..... 381/388

* cited by examiner

*Primary Examiner*—Curtis Kuntz
*Assistant Examiner*—Suhan Ni
(74) *Attorney, Agent, or Firm*—Pro-Techtor International Services

(57) ABSTRACT

A flat speaker without grille mounted thereon for a computer comprises a cabinet having a center recess with a circumferential flange formed in recess for securing speaker cone, a paper corrugation of the speaker glued to a diaphragm by a sticky ring for enabling a synchronous motion of diaphragm and corrugation, and a cushion provided along an inner perimeter of diaphragm for acting as a cushion between diaphragm and cabinet without interfering with the motion of diaphragm, wherein diaphragm may produce a sound by means of the speaker. A pattern may be printed or painted along an outer perimeter of the diaphragm. Further, two opposing longitudinal side grooves may receive a photograph therebetween for acting as a photo frame, and a three-way connector are provided on back of cabinet having three openings for securing cabinet to base in three directions.

6 Claims, 5 Drawing Sheets

FLAT SPEAKERS FOR PERSONAL COMPUTER

FIELD OF THE INVENTION

The present invention relates to speakers, and more particularly to flat speakers for a personal computer in a multimedia environment.

BACKGROUND OF THE INVENTION

Speakers are typical peripheral devices for a personal computer of modern times. A conventional speaker for computer is made of plastic material having a grille on a front side thereof for amplifying sound to a desired volume. However, such conventional speakers are monotonous in their external appearance due to the design of grille. The only possible design difference between any two speakers is the shape of cabinet. Thus, there is no breakthrough to the design of grille.

It is desirable to provide a new and improved speaker to overcome the above limitation of prior art.

SUMMARY OF THE INVENTION

It is therefore an object of the present invention to provide flat speakers for a personal computer having a diaphragm glued to the front side of cone for amplifying the sound and thus a conventional grille is eliminated. Further, a variety of patterns may be printed or painted on the flat front side to provide a sightly appearance.

It is another object of the present invention to provide flat speakers for a personal computer having a smaller horizontal length as compared with a conventional one, whereby it is possible to put it on table without occupying much space, or alternatively to mount it on the wall because of its lightweight.

It is still another object of the present invention to provide flat speakers for a personal computer including a pair of opposing longitudinal groove members of generally E-shaped section provided on the side edges for placing a photograph or picture therebetween for acting as a photo frame additionally.

It is further object of the present invention to provide flat speakers for a personal computer in which a three-way connector is provided on the back of cabinet for allowing three different securing directions to be implemented between cabinet and the projected stand of speaker base, whereby three different configurations are realized.

The above and other objects, features and advantages of the present invention will become apparent from the following detailed description taken with the accompanying drawings.

DETAILED DESCRIPTION OF THE PREFERRED EMBODIMENTS

Figure 1:
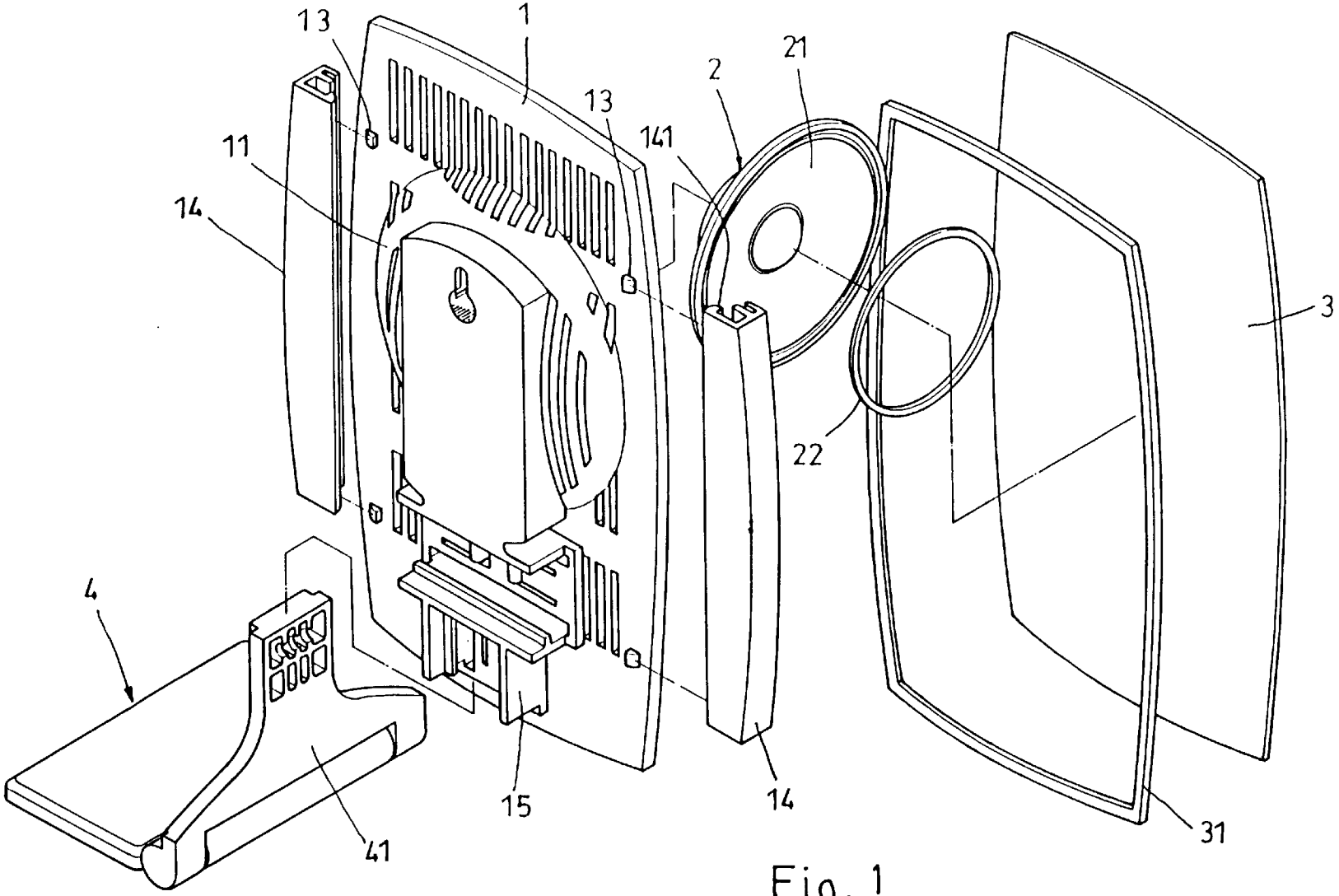
FIG. 1 is an exploded view of the presewnt invention.
Figure 2:
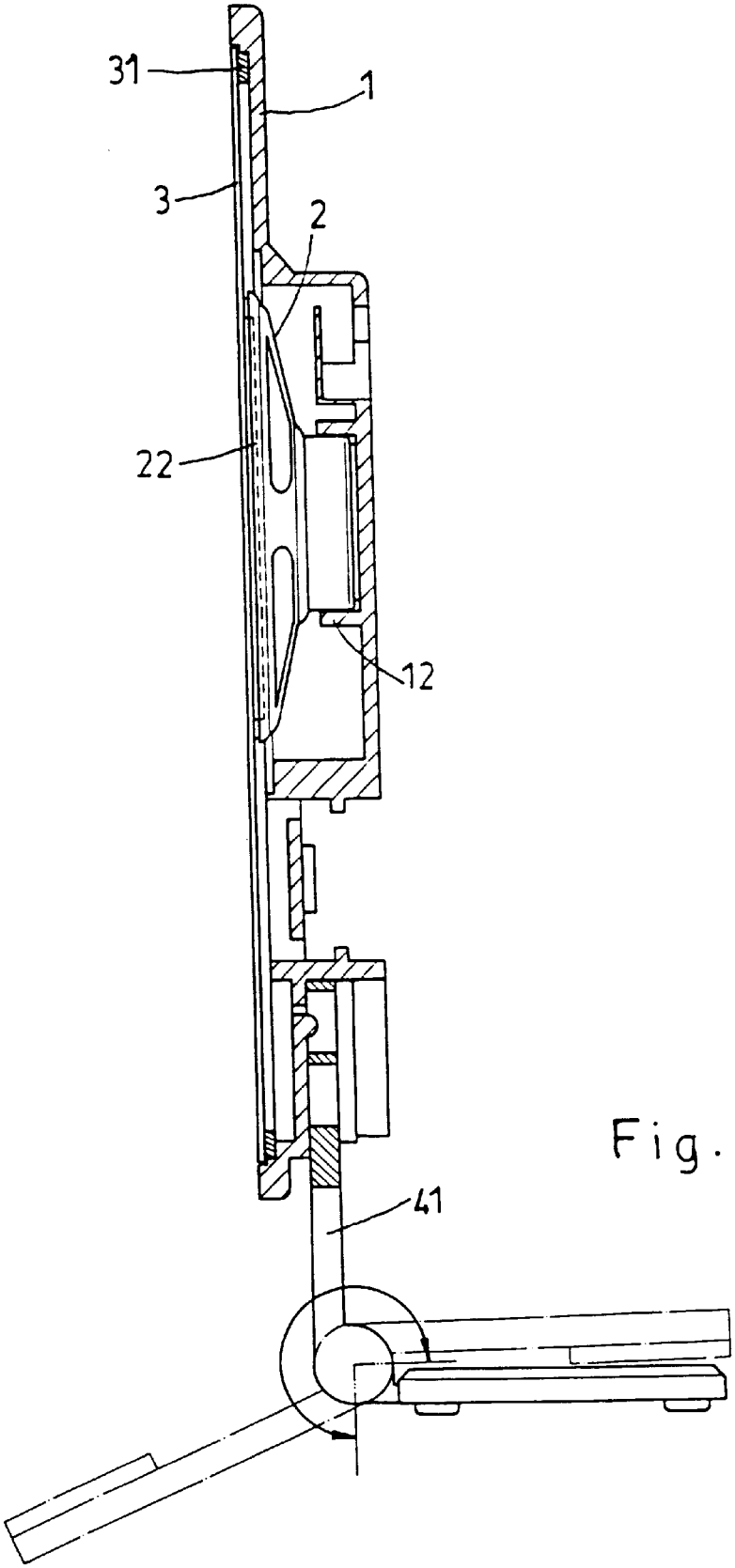
FIG. 2 is a sectional view of FIG. 1.
Figure 3:
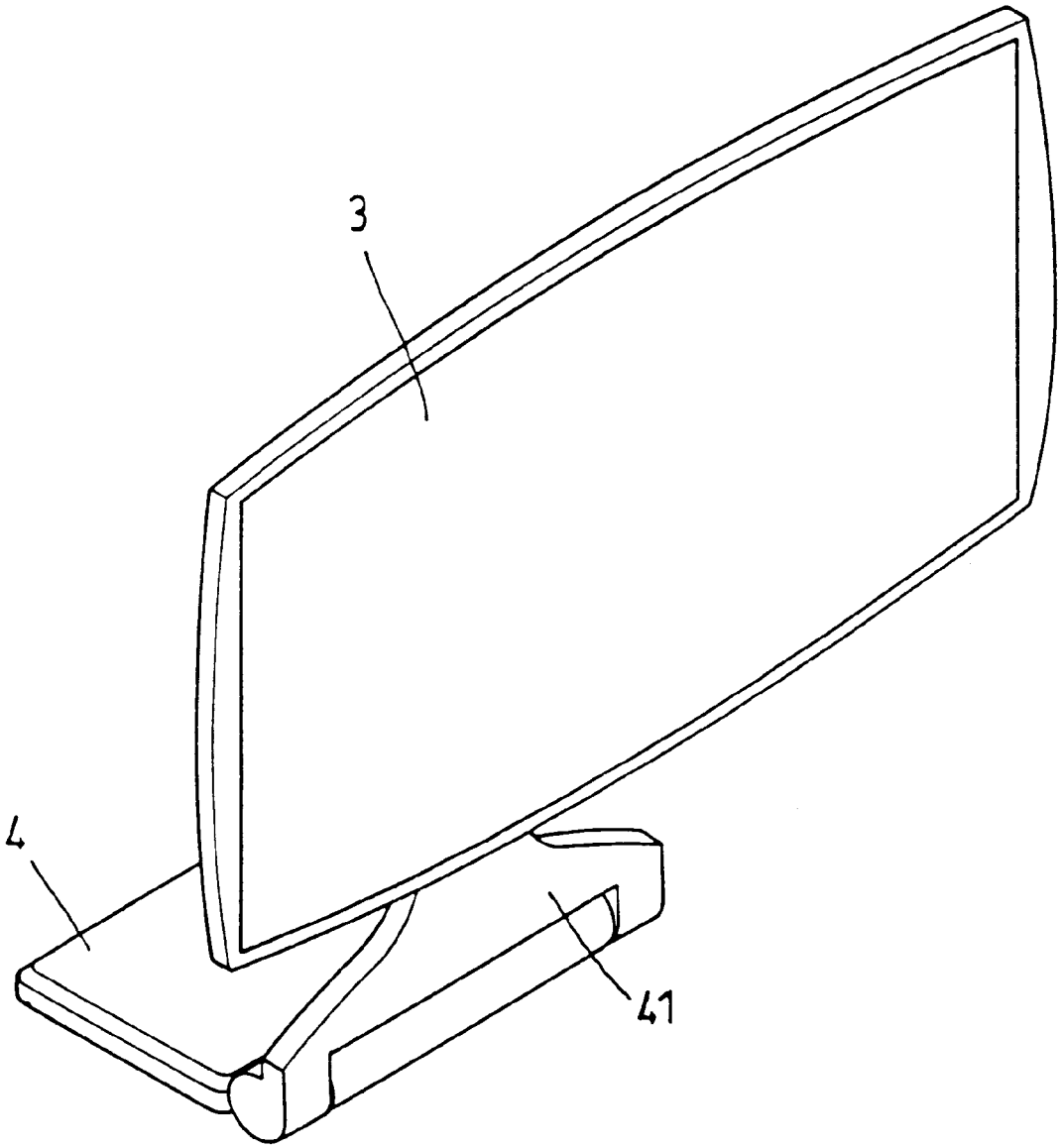
FIG. 3 is a perspective view of FIG. 1.

Referring to FIGS. 1–3, there is shown a flat speaker of the invention comprising a cabinet 1 having a round center recess 11 with a projected circumferential flange 12 formed on center portion of the bottom of the recess 11. A speaker 2 is received in the recess 11 with the cone shaped magnet portion thereof secured within the flange 12. The circumferential portion of paper corrugation 21 of speaker 2 is glued to a diaphragm 3 by a sticky ring 22 for enabling a synchronous motion of diaphragm 3 and paper corrugation 21. Diaphragm 3 may be implemented in one of predetermined shapes. Further, a predetermined pattern may be printed or painted along the outer perimeter of the diaphragm 3 to provide a sightly appearance. A cushion 31 is provided along the inner perimeter of the diaphragm 3 for providing a cushion effect between diaphragm 3 and cabinet 1. It is noted that the provision of cushion 31 does not interfere with the motion of diaphragm 3. By utilizing this construction, diaphragm 3 may produce a stereo sound by means of speaker 2. Further, any type of grilles is eliminated on the front surface of diaphragm 3 as opposed to conventional speakers, whereby a flat speaker configuration is realized as specifically shown in FIG. 3.

Figure 4:
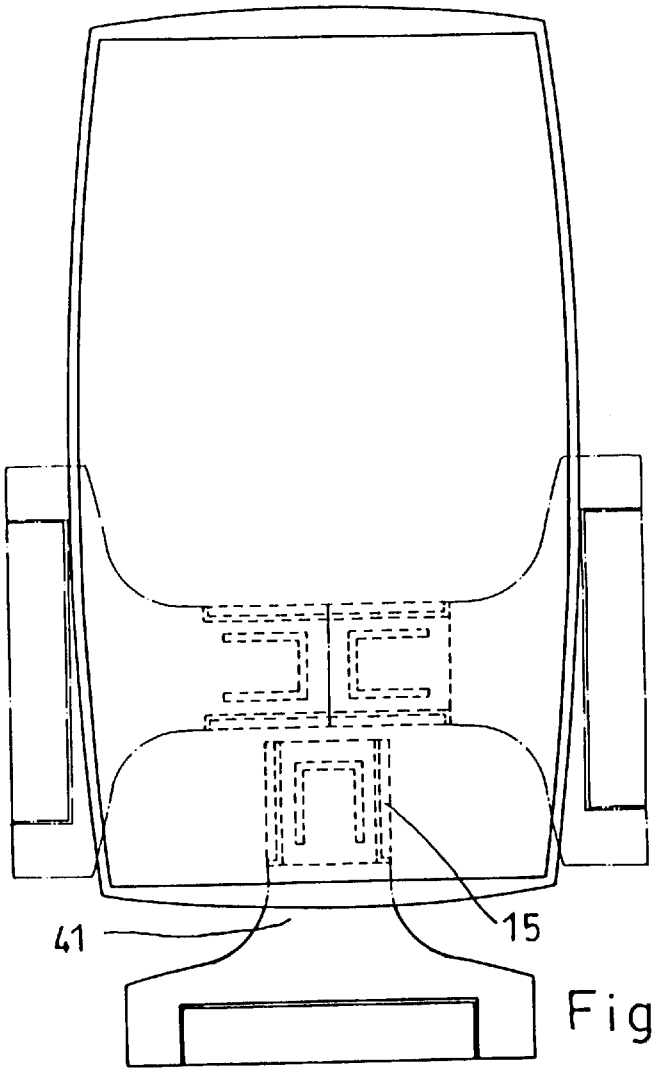
FIG. 4 is an operational view showing three different securing directions between cabinet and stand.

Further, a three-way connector 15 is provided on the back of cabinet 1 having three openings toward left, right, and bottom directions as shown in FIG. 4. As such, cabinet 1 may be secured to the projected stand 41 of speaker base 4 in three different directions. Such different configurations are realized for conforming to the pattern printed or painted on the diaphragm 3, whereby a sightly appearance is obtained.

Figure 5:
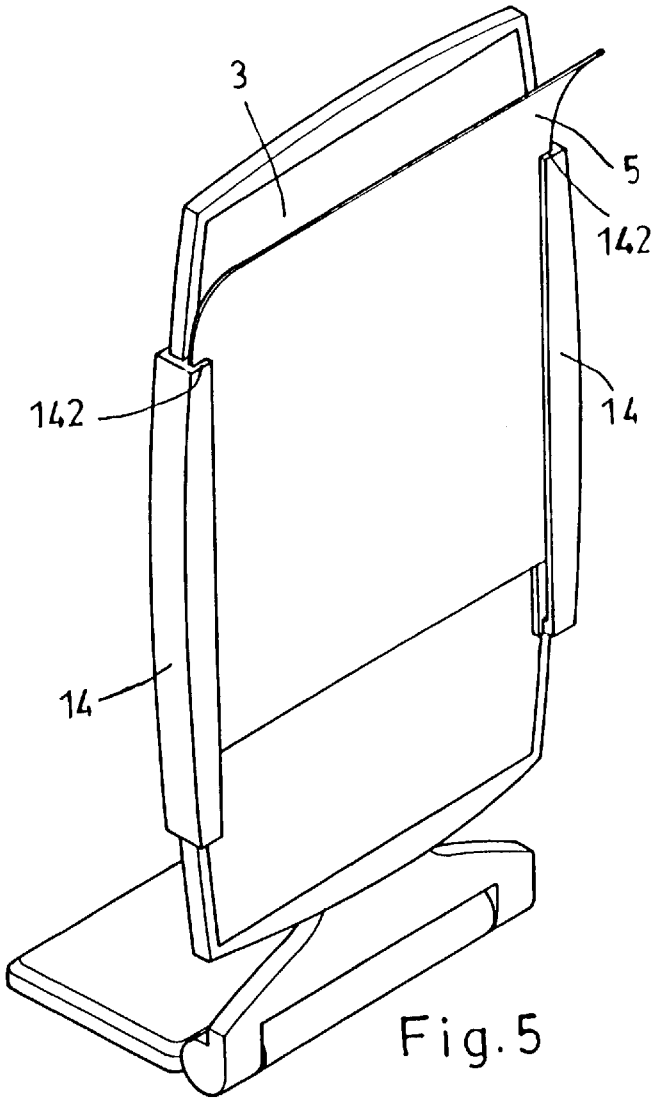
FIG. 5 is an embodiment of the present invention.

FIGS. 1 and 5 illustrate a pair of opposing longitudinal groove members 14 having a generally E-shaped section provided on the side edges. Further, two tabs 13 are provided on each of two opposing sides of the back of cabinet 1. Thus, longitudinal hook edge 141 of each of the groove members 14 can be clung to the corresponding tabs 13 for securing groove members 14 to cabinet 1. Furthermore, a longitudinal groove 142 is provided on each of groove members 14. As such, a photograph or picture may be placed between the grooves 142 for enabling the cabinet 1 to act as a photo frame additionally.

Figure 6:
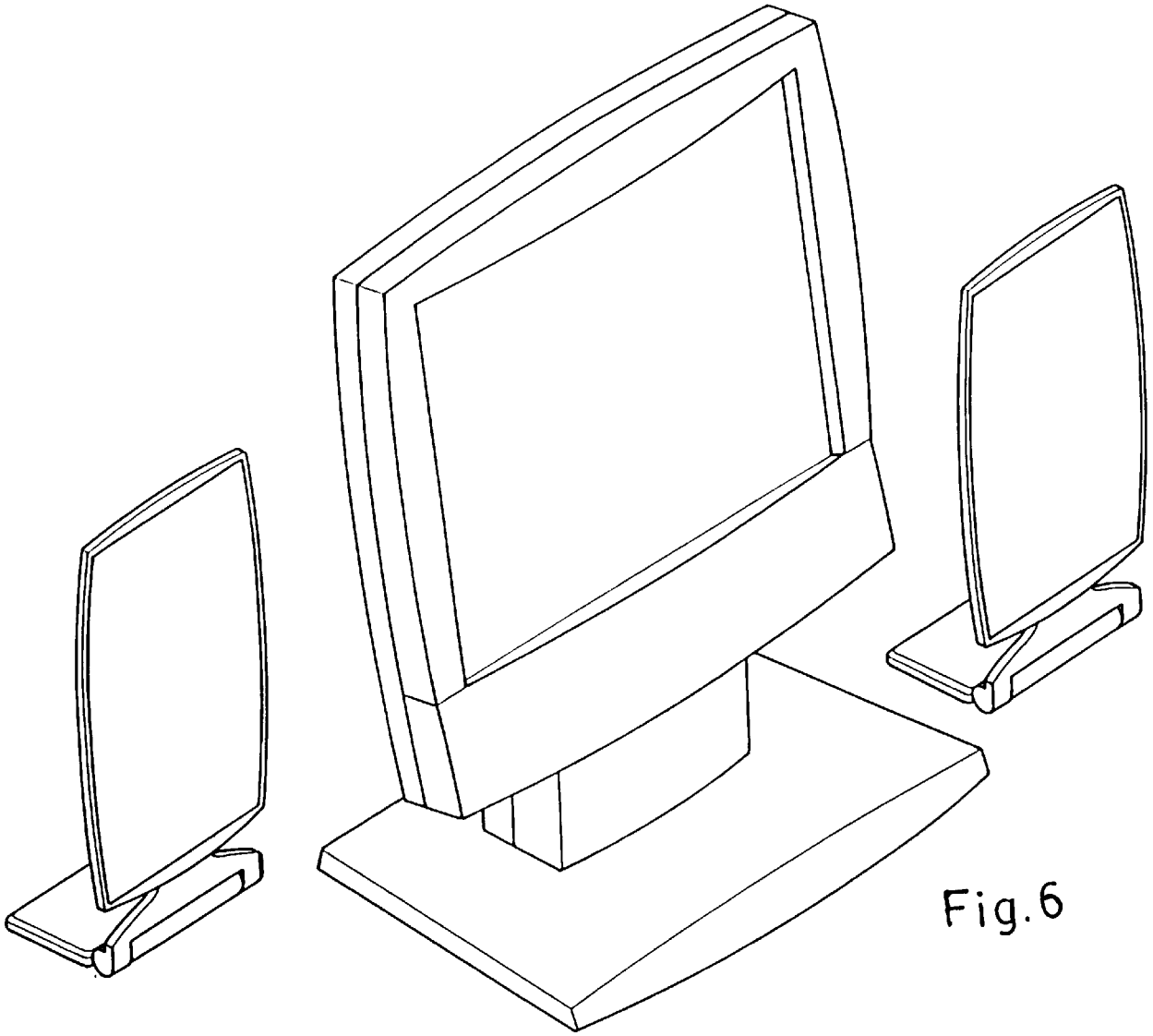
FIG. 6 is another embodiment of the present invention.

It is noted that it is possible to put flat speaker of the invention on a table without occupying much space. For example, as shown in FIG. 6, an LCD monitor of a computer is arranged between two flat speakers. Alternatively, it is possible to mount flat speaker of the invention on the wall because of its lightweight. All such embodiments can preserve the speaker's appearance.

While the invention herein disclosed has been described by means of specific embodiments, numerous modifications and variations could be made thereto by those skilled in the art without departing from the scope of the invention set forth in the claims.

What is claimed is:

1. A flat speaker for a personal computer in a multimedia environment comprising:

a diaphragm;

a cabinet having a round center recess with a projected circumferential flange formed on a center portion of a bottom of the recess for receiving the speaker in the recess with a cone shaped magnet portion thereof secured within the flange, a circumferential portion of a paper corrugation of the speaker glued to the diaphragm by a sticky ring for enabling a synchronous motion of the diaphragm and the paper corrugation;

a cushion provided along an inner perimeter of the diaphragm for providing a cushion effect between the diaphragm and the cabinet without interfering with the motion of the diaphragm; and a base having a projected stand portion;

wherein the diaphragm may produce a stereo sound by means of the speaker while without any grille mounted on a front surface of the diaphragm, whereby the flat speaker is realized.

2. The flat speaker of claim 1, wherein a predetermined pattern may be printed or painted along an outer perimeter of the diaphragm.

3. The flat speaker of claim 1, wherein the diaphragm may be implemented in one of predetermined shapes.

4. The flat speaker of claim 1, further comprising a pair of opposing longitudinal groove members having a generally E-shaped section, and two tabs provided on each of two opposing sides of a back of the cabinet, whereby a longitudinal hook edge of each of the groove members may be clung to the corresponding tabs for securing the groove members to the cabinet.

5. The flat speaker of claim 4, further comprising a longitudinal groove provided on each of the groove members for receiving a photograph or picture therebetween.

6. The flat speaker of claim 1, further comprising a three-way connector provided on the back of the cabinet having three openings toward left, right, and bottom directions for enabling the cabinet to secure to the projected stand portion of the base in the three different directions.

* * * * *